US007796935B2

(12) United States Patent
Fujita et al.

(10) Patent No.: US 7,796,935 B2
(45) Date of Patent: Sep. 14, 2010

(54) PROCESS CARTRIDGE AND IMAGE FORMING APPARATUS INCLUDING SAME

(75) Inventors: Tetsumaru Fujita, Nishinomiya (JP); Yuji Nagatomo, Minoo (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 12/178,108

(22) Filed: Jul. 23, 2008

(65) Prior Publication Data

US 2009/0028606 A1 Jan. 29, 2009

(30) Foreign Application Priority Data

Jul. 25, 2007 (JP) ..... 2007-193818

(51) Int. Cl.
*G03G 21/00* (2006.01)

(52) U.S. Cl. ..... 399/353; 399/111; 399/123

(58) Field of Classification Search ..... 399/111, 399/123, 343, 353
See application file for complete search history.

(56) References Cited

U.S. PATENT DOCUMENTS 5,212,530 A * 5/1993 Harada et al. ..... 399/349
5,233,399 A * 8/1993 Shiino et al. ..... 399/353
6,493,535 B2 * 12/2002 Okubo ..... 399/353
2007/0059034 A1 3/2007 Fujita
2007/0065179 A1 3/2007 Fujita
2007/0172259 A1 7/2007 Fujita
2007/0280735 A1 12/2007 Nagatomo et al.
2008/0038017 A1 2/2008 Fujita et al.
2008/0056745 A1 3/2008 Fujita et al.
2008/0069592 A1 3/2008 Fujita et al.

FOREIGN PATENT DOCUMENTS

JP 2005-17463 1/2005
JP 2005-234481 9/2005

OTHER PUBLICATIONS

U.S. Appl. No. 12/204,083, filed Sep. 4, 2008, Fujita, et al.

* cited by examiner

*Primary Examiner*—Hoan Tran
(74) *Attorney, Agent, or Firm*—Oblon, Spivak, McClelland, Maier & Neustadt, L.L.P.

(57) ABSTRACT

A process cartridge includes a latent image carrier, a charging unit, a latent image forming unit, a developing unit, a transfer unit, a rotary brush contacting a curved surface of the latent image carrier to form a nip, and a brush housing including a first tip and a second tip, covering the rotary brush such that a place where the rotary brush contacts the latent image carrier is opened. A downstream end of the nip where the rotary brush contacts the latent image carrier in the rotation direction of the rotary brush is not higher than a center of curvature of the latent image carrier where the rotary brush contacts, and the first tip of the brush housing is downstream of the rotary brush, further toward the latent image carrier than a tangent to the surface of the latent image carrier at the downstream end of the nip.

19 Claims, 8 Drawing Sheets

PROCESS CARTRIDGE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2007-193818 filed on Jul. 25, 2007 in the Japan Patent Office, the entire contents of which is hereby incorporated herein by reference.

BACKGROUND OF THE INVENTION

1. Field of the Invention

Exemplary aspects of the present invention generally relate to a process cartridge and an image forming apparatus such as a copier, a printer, a facsimile and the like including the same, and more particularly, to a process cartridge using a rotary brush and a brush housing, and an image forming apparatus including the same.

2. Description of the Background Art

Conventionally, a cleaning brush is provided to a cleaning unit to clean residual toner remaining on a drum-type photoreceptor serving as an image bearing member after a toner image is transferred from the image bearing member. The cleaning brush is generally a rotary brush that contacts the surface of the photoreceptor.

Such a cleaning unit including the rotary brush removes the transfer residual toner either directly with the rotary brush or by dispersing the transfer residual toner with the rotary brush to enable the transfer residual toner to easily pass a contact portion of the photoreceptor, after which the transfer residual toner is removed by a different cleaning member.

In the cleaning unit including the rotary brush, rotation of the rotary brush causes the toner to separate from the photoreceptor surface and the rotary brush, and travel in the air. Consequently, when the toner is dispersed outside the cleaning unit, the toner may stick to a charging member, a transfer member, a developing member, and so forth, thereby contaminating the interior of the image forming apparatus and thus causing charging failure, mottled images, background contamination, and so forth, resulting in deterioration of image quality.

Japanese Patent Unexamined Application Publications No. 2005-17463 and 2005-234481 disclose a cleaning unit in which the rotary brush collects the transfer residual toner by contacting the surface of the photoreceptor.

In an attempt to prevent the toner from being dispersed, the cleaning unit disclosed in Japanese Patent Unexamined Application Publications No. 2005-17463 and 2005-234481 is provided with a housing which covers the rotary brush such that an opening in the housing is located at a position where the rotary brush contacts the photoreceptor.

However, an installation position of the rotary brush and the housing of the cleaning unit according to the related art cleaning units may not adequately prevent the toner from being dispersed externally, for the following reason.

When the rotary brush contacts the photoreceptor while rotating, the toner is dispersed from a downstream end of a place, a so-called "nip", at which the rotary brush contacts the photoreceptor in the rotation direction of the rotary brush because the tip of the brush is flexed to face upstream of the rotation direction of the rotary brush at the nip.

At the downstream end of the nip in the rotation direction of the rotary brush, when the flexed brush tip separates from the photoreceptor, the flexed brush tip recovers from its flexed state to the original state, and the recovering force of the brush tip brushes and disperses toner on the photoreceptor. Consequently, the toner is dispersed from the downstream end of the nip in the rotation direction of the brush.

The present inventors have observed that, when no gravity acts, the toner getting dispersed from the downstream end of the nip is most likely to travel toward the rotary brush further than a tangent Lt to the surface of the photoreceptor, which is the downstream end of the nip.

In other words, the toner traveling to an orbit farthest away from the rotary brush among other toner getting dispersed from the downstream end of the nip in the rotation direction of the brush is the toner that travels to the direction of the tangent Lt to the photoreceptor surface which is the downstream end of the nip when the toner starts to get dispersed.

The present inventors investigated the relative positions of the rotary brush and the brush housing relative to the photoreceptor, and the toner dispersion.

Referring to FIGS. 8A and 8B, there are provided conceptual diagrams illustrating the photoreceptor and the rotary brush when a downstream nip end E of a nip N in a rotary direction of the rotary brush is positioned substantially higher than the center of rotation 1P of the photoreceptor 1. The nip N is a place where the rotary brush 2 contacts the photoreceptor 1.

As illustrated in FIGS. 8A and 8B, when the photoreceptor 1 is a drum type, the center of curvature of the surface of the photoreceptor 1 where the rotary brush 2 contacts is the center of rotation 1P of the photoreceptor 1.

FIG. 8A illustrates the rotary brush 2 and the photoreceptor 1, when the surface movement direction of the photoreceptor 1 is the same as the movement direction of the brush tip of the rotary brush 2 in the nip N. FIG. 8B illustrates the rotary brush 2 and the photoreceptor 1, when the surface movement direction of the photoreceptor 1 is opposite to the surface movement direction of the brush tip of the rotary brush 2 in the brush nip N (so-called "counter-rotation").

In the rotary brush 2 of FIGS. 8A and 8B, the traveling direction of the dispersed toner T changes over time due to the effect of gravity such that the dispersed toner T travels toward the photoreceptor 1 further than the tangent Lt to the surface of the photoreceptor 1 at the downstream nip end E of the nip N in the rotary direction of the rotary brush.

In other words, the traveling direction of the dispersed toner T traveling in the direction toward the tangent Lt at the downstream nip end E changes to a direction separating from a brush housing 3 due to gravity. Consequently, it is difficult to prevent or collect the dispersed toner T traveling toward the tangent Lt by the brush housing 3.

Referring now to FIGS. 9A and 9B, there are provided conceptual diagrams illustrating the photoreceptor 1 and the rotary brush 2 when the center of rotation 1P of the photoreceptor 1 is at a substantially same level as the downstream nip end E of the nip N in the rotary direction of the rotary brush.

In FIG. 9A, the surface movement direction of the photoreceptor 1 is the same as the movement direction of the brush tip of the rotary brush 2 in the brush nip N. In FIG. 9B, the surface movement direction of the photoreceptor 1 is opposite to the movement direction of the brush tip of the rotary brush 2 (counter-rotation).

In the rotary brush 2 as illustrated in FIGS. 9A and 9B, even if the dispersed toner T is affected by gravity, the traveling direction of the dispersed toner T does not change. That is, the dispersed toner T does not travel toward the photoreceptor 1 further than the tangent Lt at the downstream nip end E. Particularly, the dispersed toner T traveling toward the tangent Lt at the downstream nip end E remains traveling along the tangent Lt even after being affected by gravity.

The dispersed toner T traveling to the tangent Lt at the downstream nip end E is the toner that travels to an orbit farthest away from the rotary brush 2. Other dispersed toner T travels toward the rotary brush 2 further than the tangent Lt.

Referring now to FIGS. 10A and 10B, there are provided conceptual diagrams illustrating the photoreceptor 1 and the rotary brush 2, when the downstream nip end E downstream of the brush nip N is substantially lower than the center of rotation 1P of the photoreceptor 1.

In FIG. 10A, the surface movement direction of the photoreceptor 1 is the same as the movement direction of the rotary brush 2 in the brush nip N. In FIG. 10B, the surface movement direction of the photoreceptor 1 is opposite to the movement direction of the brush tip of the rotary brush 2 (counter-rotation).

In the rotary brush 2 of FIGS. 10A and 10B, when the dispersed toner T is affected by gravity, the dispersed toner T travels toward the rotary brush 2 further than the tangent Lt to the surface of the photoreceptor 1 at the downstream nip end E. The dispersed toner T that travels to the orbit farthest away from the rotary brush 2 travels to the direction of the tangent Lt at the downstream nip end E, and when affected by gravity, the dispersed toner T travels to the rotary brush 2 further than the tangent Lt. Other toner dispersed also travels to the rotary brush 2 further than the tangent Lt.

When the photoreceptor 1 and the rotary brush 2 are disposed as illustrated in FIGS. 9A through 10B, the dispersed toner can be prevented from traveling outside the brush housing 3 by covering the rotary brush 2 side with the brush housing 3 further than the tangent Lt.

According to Japanese Patent Unexamined Application Publication No. 2005-17463, the rotary brush 2 of the cleaning unit relative to the photoreceptor 1 is positioned in a similar manner as that of FIG. 10B. According to Japanese Patent Unexamined Application Publication No. 2005-234481, the rotary brush 2 of the cleaning unit relative to the photoreceptor 1 is positioned in a similar manner as that of FIG. 10A.

However, according to the related art brush housings, a housing tip (equivalent of 3*a* in FIG. 10) at the downstream nip end E of the nip N in the rotation direction of the rotary brush is disposed more toward the rotary brush side than the tangent Lt. Consequently, the dispersed toner T traveling to the tangent Lt may escape through a space between the housing tip and the photoreceptor, thereby not adequately preventing the toner from traveling outside the brush housing.

SUMMARY OF THE INVENTION

In view of the foregoing, exemplary embodiments of the present invention provide a process cartridge and an image forming apparatus capable of reducing, if not preventing entirely, toner dispersion by a rotary brush that contacts a photoreceptor.

In one exemplary embodiment, a process cartridge includes a latent image carrier, a charging unit, a latent image forming unit, a developing unit, a transfer unit, a rotary brush, and a brush housing. The latent image carrier is configured to bear an electrostatic latent image on a surface thereof. The charging unit is configured to charge the surface. The latent image forming unit is configured to form the electrostatic latent image on the surface of the latent image carrier charged by the charging unit. The developing unit is configured to supply toner to the electrostatic latent image at a developing area so as to form a toner image. The transfer unit is configured to transfer the toner image onto a transfer medium at a transfer position. The rotary brush is configured to rotate and contact a portion of the latent image carrier surface having curvature so as to form a nip. The brush housing is configured to cover the rotary brush such that a place where the rotary brush contacts the latent image carrier is opened, and includes a first tip and a second tip. The downstream end of the nip where the rotary brush contacts the latent image carrier in the rotation direction of the rotary brush is configured to be not higher than a center of curvature of the surface of the latent image carrier where the rotary brush contacts. The first tip of the brush housing is configured to be positioned downstream of the rotary brush, at the downstream end side of the nip in the rotation direction of the brush, and configured to be further toward the latent image carrier than a tangent to the surface of the latent image carrier at the downstream end of the nip in the rotation direction of the brush.

Another exemplary embodiment provides an image forming apparatus which includes a latent image carrier, a charging unit, a latent image forming unit, a developing unit, a transfer unit, a rotary brush, and a brush housing. The latent image carrier is configured to bear an electrostatic latent image on a surface thereof. The charging unit is configured to charge the surface. The latent image forming unit is configured to form the electrostatic latent image on the surface of the latent image carrier charged by the charging unit. The developing unit is configured to supply toner to the electrostatic latent image at a developing area so as to form a toner image. The transfer unit is configured to transfer the toner image onto a transfer medium at a transfer position. The rotary brush is configured to rotate and contact a portion of the latent image carrier surface having curvature so as to form a nip. The brush housing is configured to cover the rotary brush such that a place where the rotary brush contacts the latent image carrier is opened, and includes a first tip and a second tip. The downstream end of the nip where the rotary brush contacts the latent image carrier in the rotation direction of the rotary brush is configured to be not higher than a center of curvature of the surface of the latent image carrier where the rotary brush contacts. The first tip of the brush housing is configured to be positioned downstream of the rotary brush, at the downstream end side of the nip in the rotation direction of the brush, and configured to be further toward the latent image carrier than a tangent to the surface of the latent image carrier at the downstream end of the nip in the rotation direction of the brush.

Yet another exemplary embodiment provides a method for forming an image. The method includes bearing an electrostatic latent image on a surface thereof; charging the surface of the latent image carrier; forming the electrostatic latent image on the surface of the latent image carrier charged by the charging unit; supplying toner to the electrostatic latent image at a developing area so as to form a toner image on the latent image carrier; transferring the toner image onto a transfer medium at a transfer position; rotating and contacting the surface of the latent image carrier forming a nip; and covering the rotary brush such that a place where the rotary brush contacts the latent image carrier is opened, including a first tip and a second tip. A downstream end of the nip where the rotary brush contacts the latent image carrier in the rotation direction of the rotary brush is configured to be not higher than a center of curvature of the surface of the latent image carrier where the rotary brush contacts. The first tip of the brush housing is configured to be positioned downstream of the rotary brush, at the downstream end side of the nip in the rotation direction of the brush, and configured to be further toward the latent image carrier than a tangent to the surface of the latent image carrier at the downstream end of the nip in the rotation direction of the brush.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
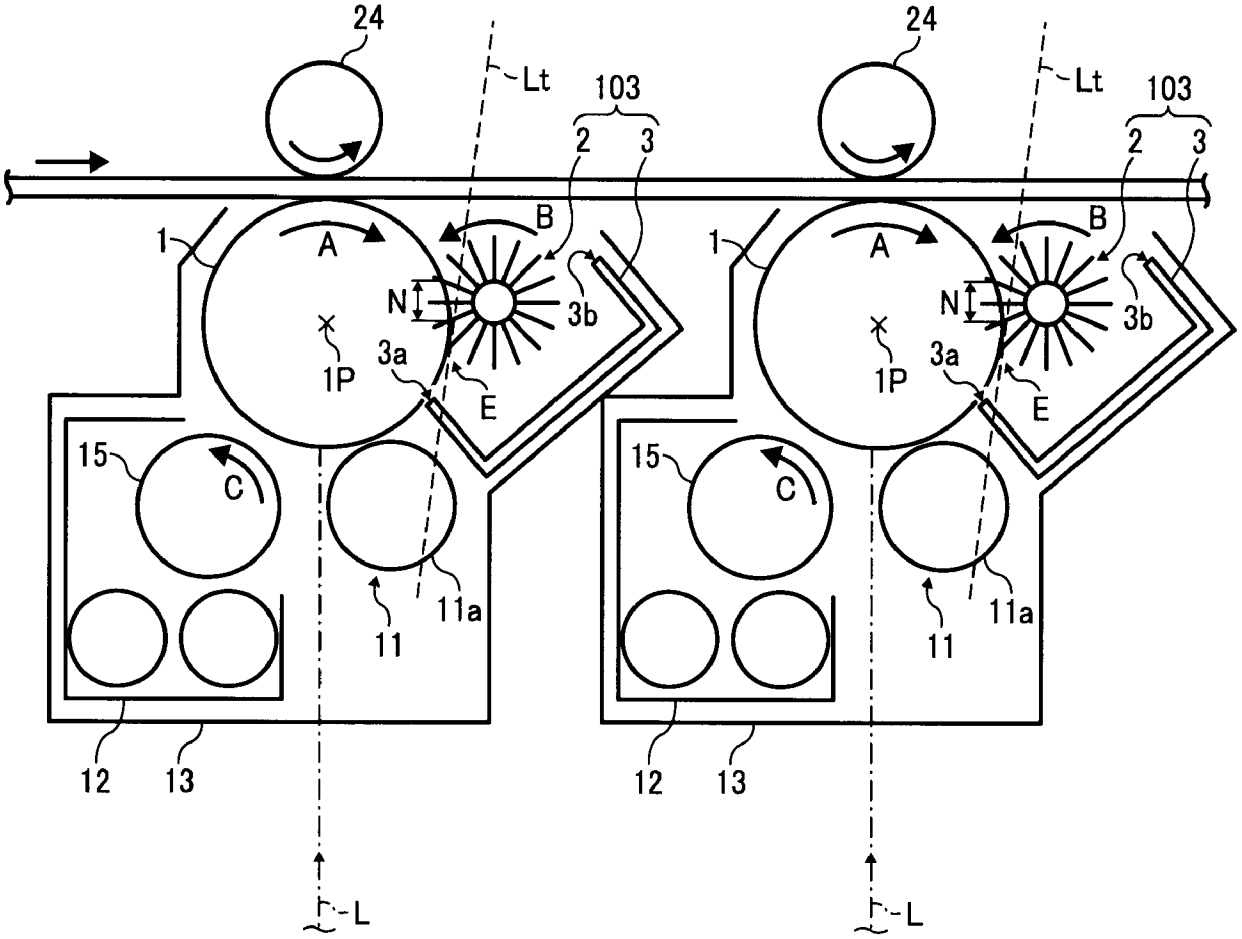
FIG. 1 is a schematic diagram illustrating a process cartridge, according to an exemplary embodiment of the present invention.

Exemplary embodiments of the present invention are now described below with reference to the accompanying drawings.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later described comparative example, exemplary embodiment, and alternative example, for the sake of simplicity of drawings and descriptions, the same reference numerals will be given to constituent elements such as parts and materials having the same functions, and redundant descriptions thereof will be omitted.

Typically, but not necessarily, paper is the medium from which is made a sheet on which an image is to be formed. It should be noted, however, that other printable media are available in sheet, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus, for example, a printer 100, according to an exemplary embodiment of the present invention is described.

The image forming apparatus according to the exemplary embodiment is a tandem-type image forming apparatus using an intermediate-transfer method. However, it is to be noted that the image forming apparatus is not limited to the structure illustrated in FIG. 1.

Figure 2:
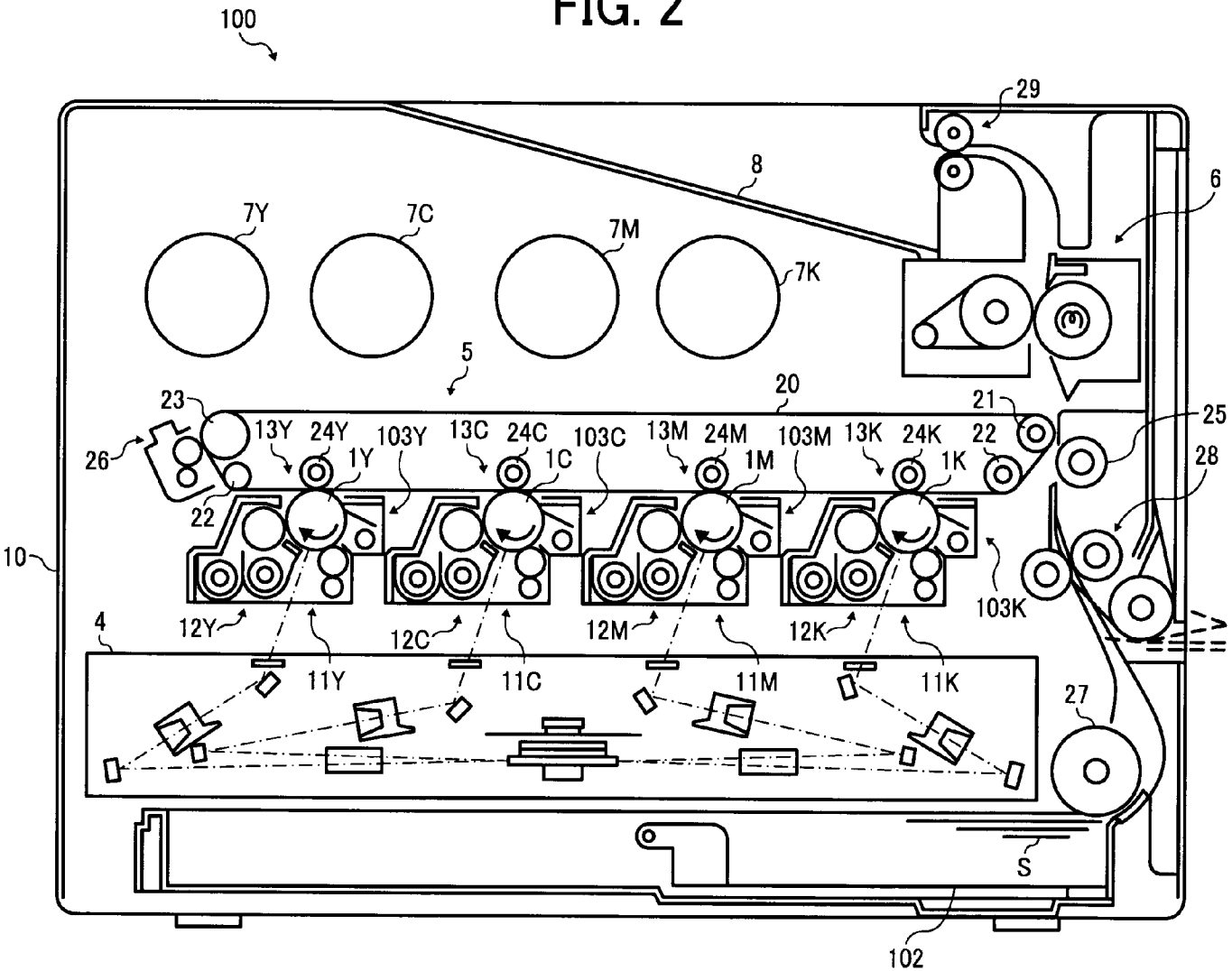
FIG. 2 is a schematic diagram illustrating a printer as an example of an image forming apparatus, according to an exemplary embodiment of the present invention.

FIG. 2 is a schematic diagram illustrating one exemplary structure of the image forming apparatus 100, according to an exemplary embodiment of the present invention.

In FIG. 2, the image forming apparatus 100 includes at least a main body 10 and a sheet feed cassette 102 which can be pulled out from the main body 10.

In substantially the center of the main body 10, process cartridges 13Y, 13C, 13M and 13K are provided. The process cartridges 13Y, 13C, 13M and 13K serve as image forming units configured to form toner images, that is, visible images of yellow (Y), cyan (C), magenta (M), and black (K), respectively. Letter symbols Y, C, M, and K each denote colors of yellow, cyan, magenta, and black, respectively.

FIG. 1 is a schematic diagram illustrating two neighboring process cartridges among the process cartridges 13Y, 13C, 13M and 13K. The process cartridges 13Y, 13C, 13M and 13K have a similar if not the same structure except the color of toner. Thus, the letter symbols denoting each color are omitted herein.

As illustrated in FIGS. 1 and 2, the process cartridge 13 includes a drum-type photoreceptor 1 serving as a latent image carrier which rotates in a direction shown by an arrow A. The photoreceptor 1 includes an aluminum cylinder covered with a photosensitive layer made of organic photo conductor (OPC), for example.

The process cartridge 13 further includes a charging unit 11, a developing unit 12, a cleaning unit 103, and so forth, disposed around the photoreceptor 1.

The charging unit 11 is configured to charge the surface of the photoreceptor 1. The developing unit 12, serving as a developing mechanism, is configured to develop a latent image formed on the photoreceptor 1. The cleaning unit 103 is configured to clean residual toner remaining on the photoreceptor 1 after a primary transfer of an image.

The charging unit 11 includes a charging roller 11*a* disposed in a non-contact manner relative to the photoreceptor 1. It is to be noted, however, a charging method of the charging unit 11 is not limited to using the charging roller 11*a*.

As illustrated in FIG. 2, an exposure unit 4 is provided substantially below the process cartridges 13Y, 13C, 13M, and 13K, and configured to irradiate the photoreceptors 1Y, 1C, 1M, and 1K with a laser beam L.

An intermediate transfer unit 5 is provided substantially above the process cartridges 13Y, 13C, 13M, and 13K, and includes an intermediate transfer belt 20 serving as an intermediate transfer medium onto which the toner images formed on the photoreceptors 1Y, 1C, 1M, and 1K are transferred.

A fixing unit 6 is provided so as to fix the toner images transferred on the intermediate transfer belt 20 onto a recording sheet S serving as a recording medium.

Toner bottles 7Y, 7C, 7M, and 7K are provided substantially above the main body 10. The toner bottles 7Y, 7C, 7M, and 7K are detachable from the main body 10 when a catch tray 8 disposed at substantially the upper portion of the main body 10 is opened.

In the exposure unit 4, a laser beam L emitted from a laser diode serving as a light source is deflected by a polygon mirror and so forth, and scans the surface of the photoreceptors 1Y, 1C, 1M, and 1K.

The intermediate transfer belt 20 of the intermediate transfer unit 5 is wound around and stretched between a driving roller 21, a tension roller 22, and a driven roller 23, and rotatably driven in the counter-clockwise direction in FIG. 2 at a predetermined timing.

The intermediate transfer unit 5 further includes a primary transfer rollers 24Y, 24C, 24M, and 24K, and a secondary transfer roller 25. The primary transfer rollers 24Y through 24K are configured to transfer the toner images transferred onto each of the photoreceptors 1 onto the intermediate transfer belt 20.

The secondary transfer roller 25 is configured to transfer the toner images transferred onto the intermediate transfer belt 20 onto the transfer sheet S.

Furthermore, the intermediate transfer unit 5 includes a belt cleaning unit 26 configured to clean residual toner (transfer residual toner) not having been transferred onto the recording sheet S and remaining on the intermediate transfer belt 20.

A description will be now given of a color image forming process.

First, in each of the process cartridges 13Y, 13C, 13M, and 13K, the photoreceptor 1 is uniformly charged by the charging unit 11. Subsequently, based on image information, the exposure unit 4 emits the laser beam L and scans/exposes the surface of each of the photoreceptors 1 so as to form a latent image thereon.

The latent image formed on each of the photoreceptors 1 is developed with the respective color of toner borne on a developing roller 15 serving as a developer bearing member rotating in a direction indicated by arrow C in a developing unit 12 in FIG. 1, thereby forming a toner image, that is, a visible image.

Each of the primary transfer rollers 24 causes the toner images on the photoreceptors 1 to be sequentially overlappingly transferred onto the intermediate transfer belt 20 driven to rotate in the counter-clockwise direction. Image forming operation of each color is performed at different timing from the upstream to the downstream in the traveling direction of the intermediate transfer belt such that the toner images are overlappingly transferred at the same position on the intermediate transfer belt 20.

After the primary transfer is completed, the photoreceptor 1 is cleaned by a rotary brush 2 serving as a cleaning brush of the cleaning unit 103. In preparation for the subsequent imaging cycle, the rotary brush 2 rotates in an arrow direction B in FIG. 1 to clean the surface of the photoreceptor 1.

A predetermined amount of toner is supplied from the toner bottles 7Y, 7C, 7M, and 7K to the developing units 12Y, 12C, 12M, and 12K of the respective process cartridges 13Y, 13C, 13M, and 13K by a conveyance path, not shown, as necessary.

The transfer sheet S in the sheet feed cassette 102 is transported to the main body 10 by the sheet feed roller 27 provided in the vicinity of the sheet feed cassette 102 and arrives at a pair of registration rollers 28. The pair of the registration rollers 28 transports at a predetermined timing the transfer sheet S to a secondary transfer portion in which the secondary transfer roller 25 faces the driving roller 21 nipping the intermediate transfer belt 20 therebetween.

Subsequently, in the secondary transfer portion, the toner image formed on the intermediate transfer belt 20 is transferred onto the transfer sheet S. The toner image transferred onto the transfer sheet S is fixed while passing through the fixing unit 6. Then, the transfer sheet S is discharged onto the catch tray 8 by the sheet discharge roller 29.

Similar to the photoreceptor 1, the residual toner remaining on the intermediate transfer belt 20 is cleaned by the belt cleaning unit 26 which contacts the intermediate transfer belt 20.

As described above, the process cartridges 13 each include the drum-type photoreceptor 1 serving as a latent image carrier and the cleaning unit 103 equipped with the rotary brush 2 and the brush housing 3.

The process cartridges 13 each include the charging unit 11 which uniformly charges the photoreceptor 1 to form the latent image thereon. The exposure unit 4 exposes the photoreceptor 1 to form the electrostatic latent image on the photoreceptor 1. The electrostatic latent image is developed with toner by the developing unit 12 so as to form the toner image.

The process cartridges 13 each integrally support the photoreceptor 1, the cleaning unit 103, the charging unit 11, and the developing unit 12, and is detachable from the main body 10 of the image forming apparatus 100. Accordingly, each component constituting the image forming unit can be replaced at once, thereby enhancing maintainability.

As described above, the rotary brush 2 contacts the surface of the photoreceptor 1 while rotating in the arrow B direction in FIG. 1. The brush housing 3 is provided to cover the rotary brush 2 in such a manner that the contact position of the rotary brush 2 and the photoreceptor 1 is opened.

A description will be now given of one exemplary embodiment of the present invention.

As illustrated in FIG. 1, in the process cartridge 13, according to the exemplary embodiment, the downstream nip end E of the nip N in the rotation direction of the rotary brush 2 (hereinafter simply referred to as the downstream nip end E), which is the downstream end portion of the rotary brush 2 in the rotation direction thereof, is positioned substantially lower than a horizontal plane including the center of rotation 1P of the photoreceptor 1.

In other words, the position of the downstream nip end E of the nip N in the rotation direction of the brush is substantially lower than the center of rotation 1P of the photoreceptor 1, that is, the center of curvature of the surface of the photoreceptor 1 where the rotary brush 2 contacts.

Figure 8A:
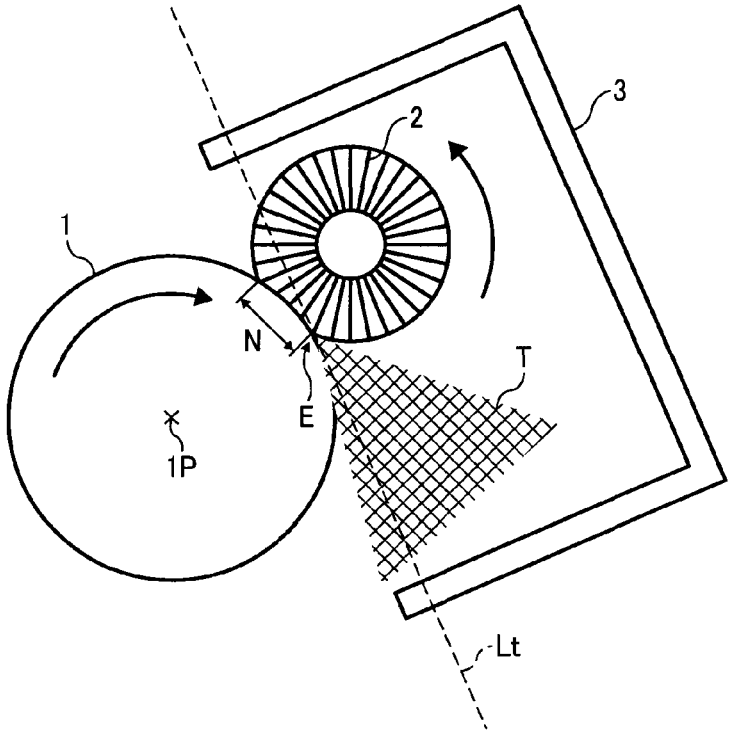
FIG. 8A RELATED ART
FIGS. 8A and 8B are conceptual diagrams illustrating the photoreceptor and the rotary brush when a downstream nip end E of a nip where the photoreceptor and the rotary brush contact in the rotary direction of the rotary brush is positioned substantially higher than the center of rotation of the photoreceptor.
Figure 8B:
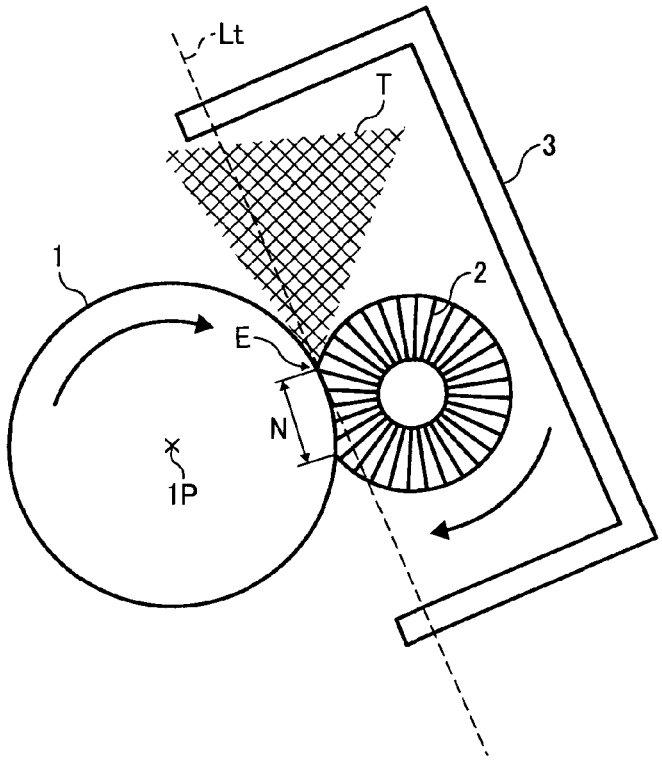
FIG. 8B RELATED ART
Figure 9A:
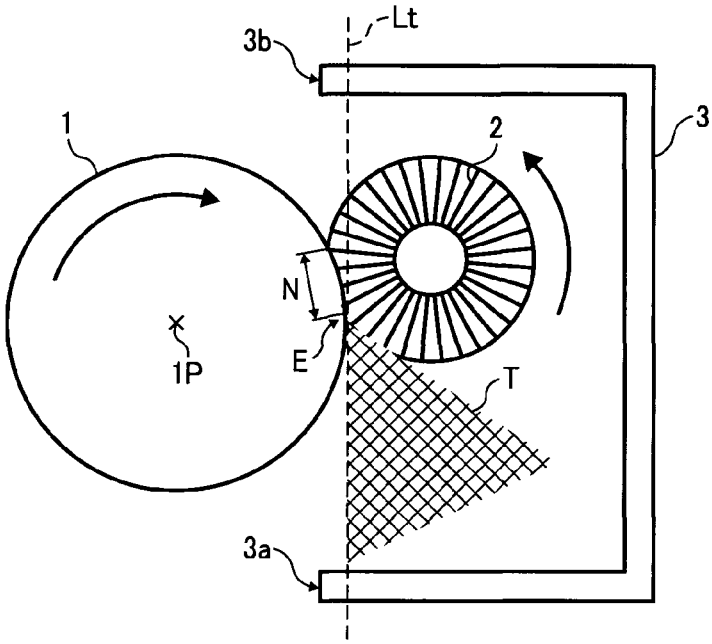
FIG. 9A RELATED ART
FIGS. 9A and 9B are conceptual diagrams illustrating the photoreceptor and the rotary brush when the center of rotation of the photoreceptor is at substantially the same level as the downstream nip end E.

Accordingly, as previously described with reference to FIGS. 8 through 10, the toner dispersed from the downstream nip end E can be directed toward the rotary brush 2 further than the tangent Lt to the surface of the photoreceptor 1 at the downstream nip end E.

Two housing ends 3*a* and 3*b* constitute an opening of the brush housing 3. The housing end 3*a* is provided downstream of the rotary brush 2 at the nip end E side relative to the nip N. The housing end 3*b* is provided at the upstream of the rotary brush 2.

The housing end 3*a* at the downstream nip end E side is disposed at the photoreceptor 1 side further than the tangent Lt. Accordingly, the toner traveling toward the rotary brush 2 further than the tangent Lt which is substantially closer to the rotary brush 2 than the housing end 3*a* can be kept inside the brush housing 3, and furthermore, all the toner dispersed from the downstream nip end E can be kept inside the brush housing 3.

As described above, since substantially all the toner dispersed from the downstream nip end E can be kept inside the brush housing 3, toner dispersion by the rotary brush 2 can be suppressed consistently, thereby reducing, if not preventing entirely, contamination of components that a user may touch upon replacement of the process cartridge 13. Maintainability by the user can be enhanced, accordingly.

When the process cartridge 13 reduces if not prevents entirely toner dispersion, the dispersed toner is prevented from reaching the primary transfer portion where the photoreceptor 1 faces the primary transfer roller 24, thus preventing generation of mottled images in the transfer portion.

Furthermore, dispersed toner is reduced if not prevented entirely from reaching the charging roller 11*a* of the charging unit 11, thereby reducing, if not preventing entirely, charge failure derived from the toner dispersion.

Still further, it is possible to prevent the dispersed toner from reaching the developing unit 12, thereby reducing, if not preventing entirely, background contamination due to toner dispersion from the rotary brush 1.

According to the exemplary embodiment, mottled images, charge failure, and background contamination caused by the toner dispersed from the rotary brush 2 can be prevented. Therefore, high-quality image formation can be achieved.

The housing end 3*a* of the housing 3 downstream of the rotary brush 2, according to the exemplary embodiment, is at the closest position to the photoreceptor 1 among other components facing the photoreceptor 1 at the downstream nip end E relative to the nip N.

The related-art housing covering the rotary brush disclosed in Japanese Patent Unexamined Application Publication No. 2005-17463 is structured such that the housing that covers the rotary brush also covers the charging roller at the downstream side in the photoreceptor surface movement direction relative to the rotary brush.

In the related art housing covering the charging roller and the rotary brush, the housing end covering the charging roller is substantially at the photoreceptor side further than the tangent to the photoreceptor at the downstream end of the nip in the rotation direction of the brush. However, the other housing end blocking a space between the charging roller and the rotary brush is more toward the rotary brush side further than the tangent to the photoreceptor downstream of the nip. Consequently, it is difficult to suppress toner traveling to the charging roller.

In the process cartridge 13 illustrated in FIG. 1, the downstream nip end E of the nip N is located substantially lower than the center of rotation 1P of the photoreceptor 1. Alternatively, however, as described with reference to FIG. 9, the downstream nip end E may be located at substantially the same level as the center of rotation 1P of the photoreceptor 1.

When the downstream nip end E is located at substantially the same level as the center of rotation 1P of the photoreceptor 1, the direction of the dispersed toner traveling to the tangent Lt direction is substantially the same direction as the direction of gravity. Therefore, the toner traveling in the farthest orbit from the rotary brush 2 travels along the tangent Lt. Consequently, when the traveling direction varies slightly, there is a possibility that the toner may travel toward the photoreceptor 1 side further than the tangent Lt, causing the toner dispersion.

According to the exemplary embodiment, when the downstream nip end E is disposed substantially lower than the center of rotation 1P of the photoreceptor 1, even if the traveling direction of toner slightly varies, substantially all toner travels toward the rotary brush 2 further than the tangent Lt, thereby making it possible to reduce, if not prevent entirely, generation of the toner dispersion.

Figure 9B:
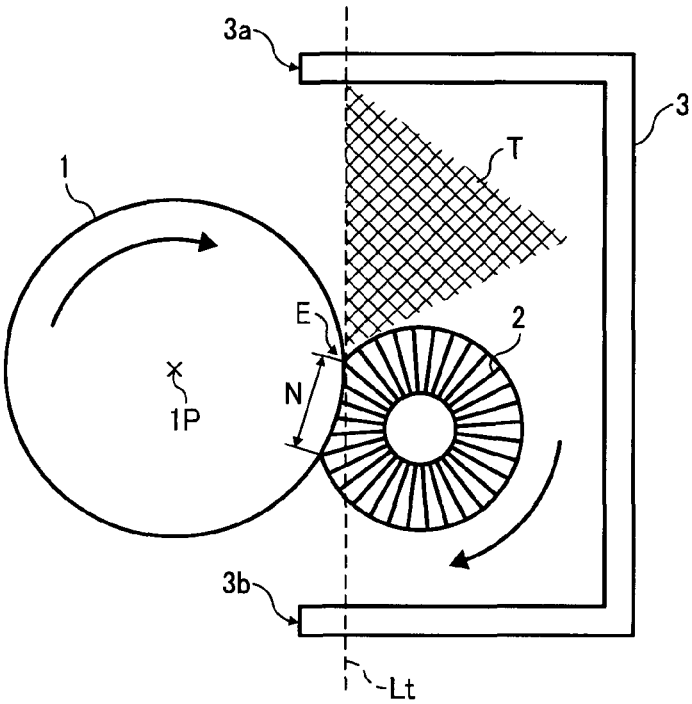
FIG. 9B RELATED ART
Figure 10A:
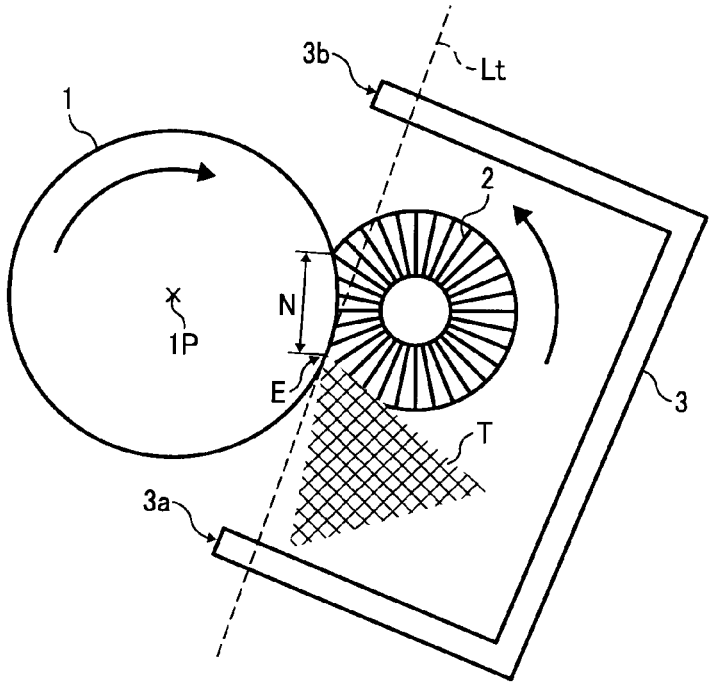
FIG. 10A RELATED ART
FIGS. 10A and 10B are conceptual diagrams illustrating the photoreceptor and the rotary brush when the downstream nip end E is substantially lower than the center of rotation of the photoreceptor.
Figure 10B:
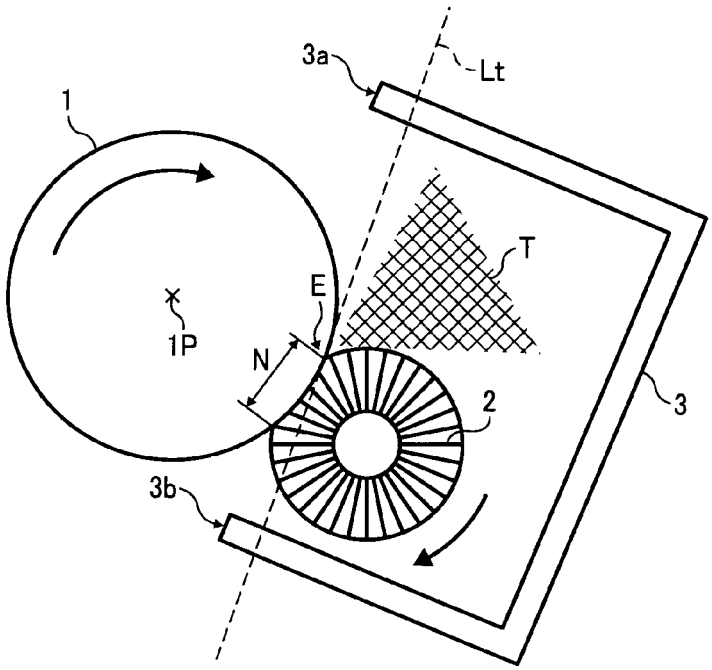
FIG. 10B RELATED ART

It is to be noted that although in the process cartridge 13 illustrated in FIG. 1, the rotation direction of the rotary brush 2 in the nip N is the same as that of the photoreceptor 1 in the nip N, the rotation direction of the rotary brush 2 is not limited thereto, and alternatively, the rotation direction of the rotary brush 2 may be opposite to that of the photoreceptor 1 in the nip N as illustrated in FIGS. 9B and 10B (so-called "counter-rotation").

When the rotary brush 2 and the photoreceptor 1 are provided in the same manner as illustrated in FIG. 1, and the rotary brush 2 rotates in the opposite direction in the nip N, the downstream nip end E in the rotation direction of the rotary brush is located at the upper end of the nip N which is higher than the center of rotation 1P of the photoreceptor 1.

Thus, when the rotary brush 2 is rotated in the opposite direction as that of the photoreceptor 1 in the nip N, the rotary brush 2 is configured to be positioned substantially lower than the position shown in FIG. 1, and the downstream nip end E is configured to be substantially lower than the center of rotation 1P of the photoreceptor 1.

Furthermore, when the rotation direction of the rotary brush 2 in the nip N is in the opposite direction of that of the photoreceptor 1, the toner dispersed from the downstream end E travels upward. However, when the brush housing 3 is disposed in a manner illustrated in FIG. 10A, it is possible to reduce, if not prevent entirely, toner dispersion.

The primary transfer roller 24 serving as a transfer mechanism transfers the toner image formed on the photoreceptor 1 onto the intermediate transfer belt 20 at a higher position than the downstream nip end E. Accordingly, it is possible to prevent the toner dispersed from the rotary brush 2 from reaching the transfer position, thereby preventing generation of mottled images, and thus maintaining high-quality imaging.

The rotary brush 2 according to the exemplary embodiment serves as a cleaning brush which removes undesirable toner from the surface of the photoreceptor 1. When removing the toner, a substantial amount of toner may be dispersed due to rotation of the rotary brush 2. Consequently, the toner dispersion may occur easily.

However, when the position of the rotary brush 2 and the brush housing 3 is configured as illustrated in FIG. 1 relative to the photoreceptor 1, the toner is prevented from getting dispersed outside the brush housing 3 even if the substantial amount of the toner is dispersed.

In the cleaning unit 103 according to the exemplary embodiment, the rotary brush 2 removes toner. Alternatively, however, the cleaning unit 103 may be equipped with a cleaning blade which contacts the downstream surface of the photoreceptor 1 in the surface movement direction thereof. When the cleaning unit 103 includes the cleaning blade, the rotary brush 2 is configured to disperse the toner such that the cleaning blade can easily remove the toner, so that the toner is easily removed by the cleaning blade and the toner passes the nip N.

According to the exemplary embodiment, the charging area of the surface of the photoreceptor 1 uniformly charged by the charging unit 11 is the downstream surface of the photoreceptor 1 in the surface movement direction thereof relative to the downstream nip end E. The charging area is also the upstream surface of the photoreceptor 1 in the surface movement direction thereof relative to the developing area.

When the rotary brush 2 rotates in the same direction as that of the photoreceptor 1 in the nip N, the toner travels downstream in the surface movement direction of the photoreceptor 1 relative to the downstream nip end E. Thus, when the rotary brush 2 causes toner to travel from the downstream nip end E, causing the toner to be dispersed outside the brush housing 3, the toner may stick to the charging roller 11*a* of the charging unit 11, thereby causing charging failure.

However, when the rotary brush 2 and the brush housing 3 are disposed in a manner as illustrated in FIG. 1 relative to the photoreceptor 1, it is possible to reduce, if not prevent entirely, the toner traveling downstream in the surface movement direction of the photoreceptor 1 from getting dispersed outside the brush housing 3. Accordingly, charging failure due to toner dispersion from the rotary brush 2 can be prevented.

A description will be now given of an example of a problem when the rotary brush 2 is disposed substantially above the photoreceptor 1.

Referring now to FIG. 3, there is provided a schematic diagram illustrating the rotary brush 2 disposed substantially above the photoreceptor 1.

Figure 3A:
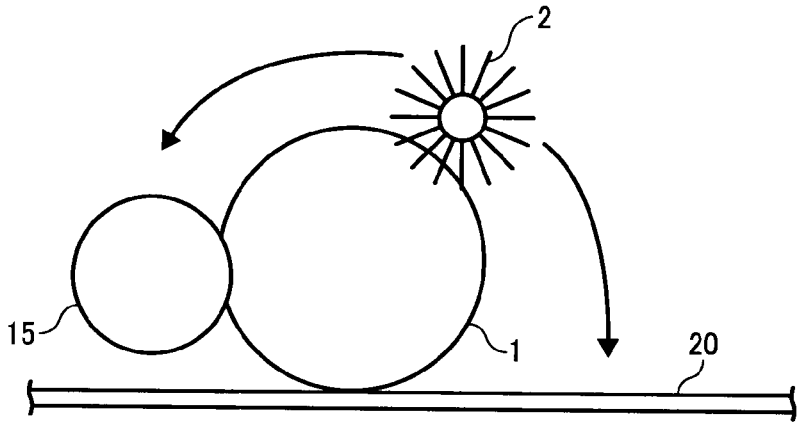
FIGS. 3A and 3B are schematic diagrams illustrating a rotary brush disposed substantially above a photoreceptor, according to an exemplary embodiment of the present invention.
Figure 3B:
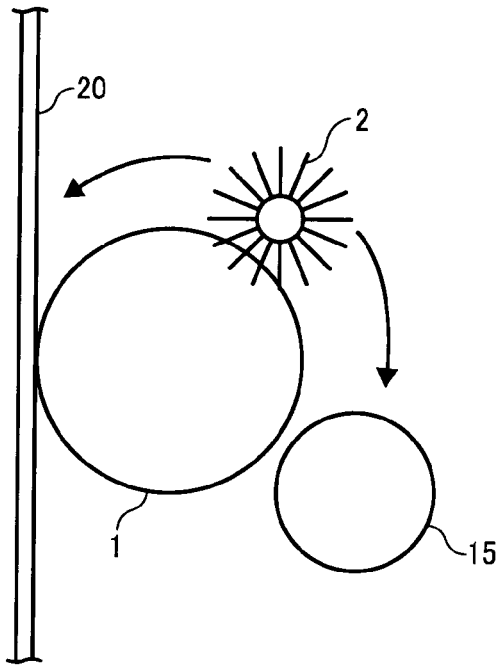

In FIG. 3A, the intermediate transfer belt 20 is disposed substantially below the photoreceptor 1. In FIG. 3B, the intermediate transfer belt 20 is disposed at the side of the photoreceptor 1.

When the rotary brush 2 is disposed substantially above the photoreceptor 1, the traveling direction of the dispersed toner indicated by arrows in FIGS. 3A and 3B is difficult to control. Consequently, in order to suppress the toner dispersion, the end of the brush housing needs to contact the surface of the photoreceptor 1.

In this case, material which does not damage the surface of the photoreceptor 1 when contacting the surface of the photoreceptor 1 needs to be selected for the housing end, thereby causing cost increase. Furthermore, the toner may be accumulated at a contact portion where the brush housing end contacts the photoreceptor 1.

By contrast, in the process cartridge 13 illustrated in FIG. 1, the housing end 3*a* downstream of the rotary brush 2 and the housing end 3*b* upstream of the rotary brush 2 do not contact the photoreceptor 1. When the rotary brush 2 and the brush housing 3 are disposed in a manner as illustrated in FIG. 1, the toner dispersion can be reduced, if not prevented entirely, without having the housing ends 3*a* and 3*b* of the brush housing 3 contact the photoreceptor 1. Accordingly, damage to the photoreceptor 1 caused by the brush housing 3 contacting the surface of the photoreceptor 1 and cost increase in selecting appropriate material for the housing end in order to prevent the damage to the photoreceptor 1 can be prevented.

As described above, the toner dispersion can be prevented without having the housing end 3*a* downstream of the brush housing 3 contact the photoreceptor 1. Alternatively, however, the housing 3*a* may contact the photoreceptor 1.

Figure 4:
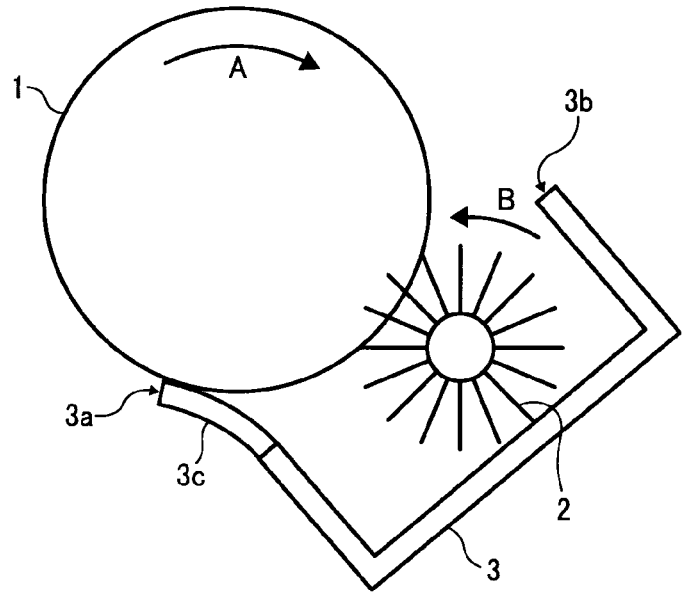
FIG. 4 is a schematic diagram illustrating the photoreceptor and a brush housing when one end of the brush housing at a downstream side of the rotary brush contacts the photoreceptor, according to an exemplary embodiment of the present invention.

Referring now to FIG. 4, there is provided a schematic diagram illustrating one example of the housing end 3*a* of the brush housing 3 contacting the photoreceptor 1. As illustrated in FIG. 4, when the housing end 3*a* contacts the surface of the photoreceptor 1, toner is prevented from passing through a place between the housing end 3*a* and the photoreceptor 1, thereby consistently preventing toner dispersion from the rotary brush 2.

In a case in which the housing end 3*a* contacts the photoreceptor 1, as illustrated in FIG. 4, a sheet member 3*c* is used to form the housing end 3*a*. The sheet member 3*c* is made from flexible material such as a urethane sheet including urethane rubber, or any other suitable material, and formed independently of the brush housing 3 and fixed thereto. When such a flexible sheet member 3*c* is used for the housing end 3*a*, damage to the surface of the photoreceptor 1 can be prevented even if the housing end 3*a* contacts the photoreceptor 1.

In FIG. 4, the flexible sheet member 3*c* forms the housing end 3*a* that contacts the surface of the photoreceptor 1. However, the flexible sheet member 3*c* forming the housing end 3*a* is not limited to a structure in which the housing end 3*a* contacts the surface of the photoreceptor 1. Alternatively, the flexible sheet member 3*c* may be used to form the housing end 3*a* which does not contact the photoreceptor surface.

The housing end 3*a* according to the exemplary embodiment is provided in a non-contact manner relative to the surface of the photoreceptor 1. However, the housing end 3*a* is disposed at the photoreceptor 1 side further than the tangent Lt, and thus, the housing end 3*a* is positioned closed to the surface of the photoreceptor 1. In such a structure, there is a possibility that the housing end 3*a* may accidentally touch the surface of the photoreceptor 1 due to vibration, for example. However, when the housing end 3*a* is formed of the flexible member 3*c*, it is possible to prevent damage to the photoreceptor 1.

In the process cartridge 13 illustrated in FIG. 1, the charging unit 11 including the charging roller 11*a* is disposed downstream of the photoreceptor 1 in the surface movement direction thereof relative to the cleaning unit 103. Alternatively, however, the charging unit 11 may be disposed upstream of the photoreceptor 1 in the surface movement direction thereof relative to the cleaning unit 103.

Figure 5:
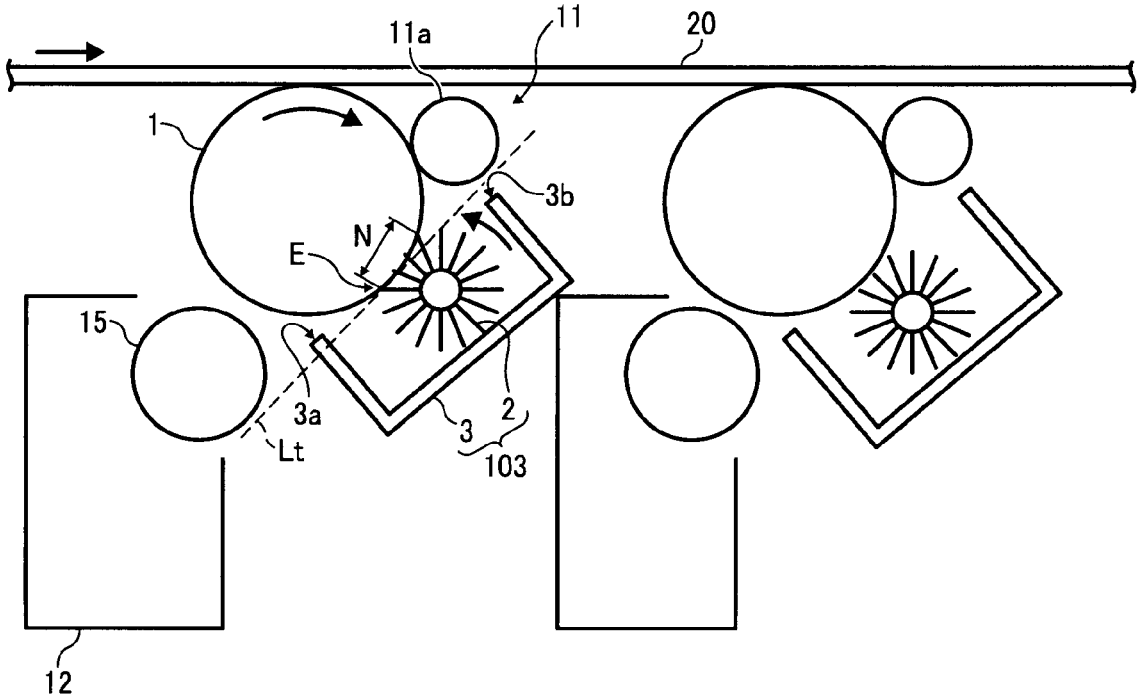
FIG. 5 is a schematic diagram illustrating a charging unit disposed upstream of a cleaning unit in a surface movement direction of the photoreceptor, according to an exemplary embodiment of the present invention.

Referring now to FIG. 5, there is provided a schematic diagram illustrating one example of the charging unit 11 disposed upstream of the photoreceptor 1 in the surface movement direction thereof relative to the cleaning unit 103, according to the exemplary embodiment.

In FIG. 5, according to the exemplary embodiment, the charging area charged by the charging unit 11*a* is at the upstream of the photoreceptor 1 in the surface movement direction thereof relative to the downstream nip end E.

When the rotary brush 2 rotates in substantially the same direction as that of the photoreceptor 1 in the nip N, the toner travels downstream in the surface movement direction of the photoreceptor 1 relative to the downstream nip end E in the rotation direction of the brush.

According to the exemplary embodiment as illustrated in FIG. 5, even if the rotary brush 2 causes the toner to travel from the downstream nip end E, causing the toner to be dispersed outside the brush housing 3, the toner does not stick to the charging roller 11*a* of the charging unit 11, thereby preventing charging failure due to the toner dispersed from the rotary brush 2.

Furthermore, according to the exemplary embodiment as illustrated in FIG. 5, the developing unit 12 is disposed downstream of the photoreceptor 1 in the surface movement direction thereof. Consequently, there is a possibility that when the rotary brush 2 causes the toner to travel from the downstream nip end E causing the toner to be dispersed outside the brush housing 3, the toner may stick to the developing roller 15 of the developing unit 12, causing background contamination.

However, when the rotary brush 2 and the brush housing 3 are disposed in a manner as illustrated in FIG. 1 relative to the photoreceptor 1, the toner traveling downstream of the photoreceptor 1 is prevented from getting dispersed outside the brush housing 3. Accordingly, even if the developing unit 12 is disposed downstream of the photoreceptor 1 in the surface movement direction thereof relative to the downstream nip end E, background contamination caused by toner dispersion from the rotary brush 2 can be prevented.

In addition, alternatively, the rotary brush 2 may be configured to serve as a charging brush by supplying a charging voltage to the rotary brush 2.

According to the exemplary embodiment illustrated in FIGS. 1 and 2, the charging unit 11 serving as the charging mechanism is provided in addition to the rotary brush 2. Alternatively, however, the rotary brush 2 may serve as the cleaning member and the charging member.

Figure 6:
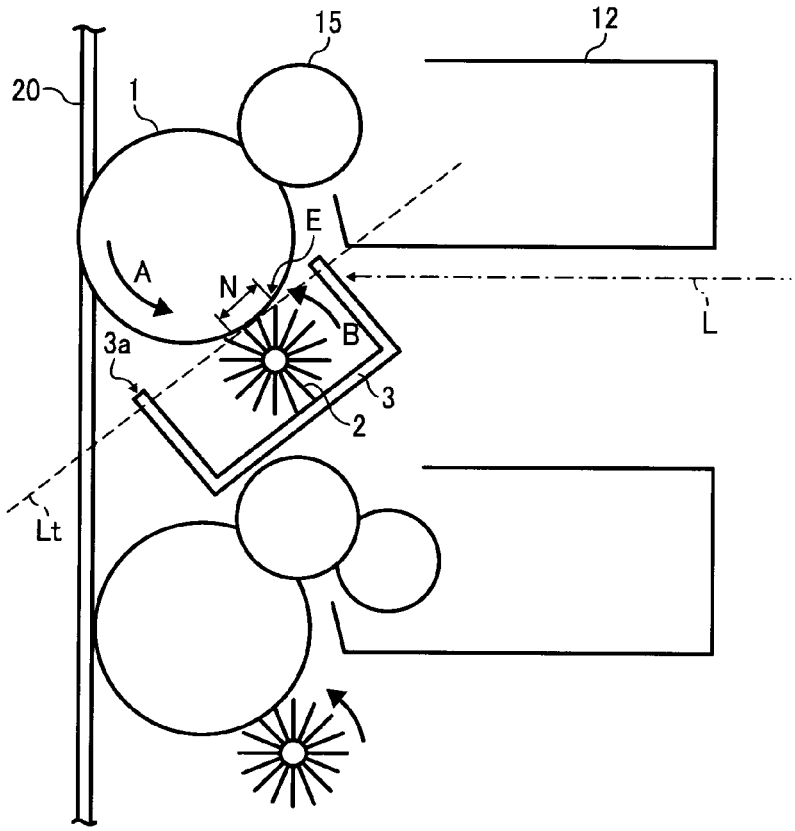
FIG. 6 is a schematic diagram illustrating a rotary brush serving as a charging member when a transfer surface of an intermediate transfer member is in a vertical position, according to an exemplary embodiment of the present invention.
Figure 7:
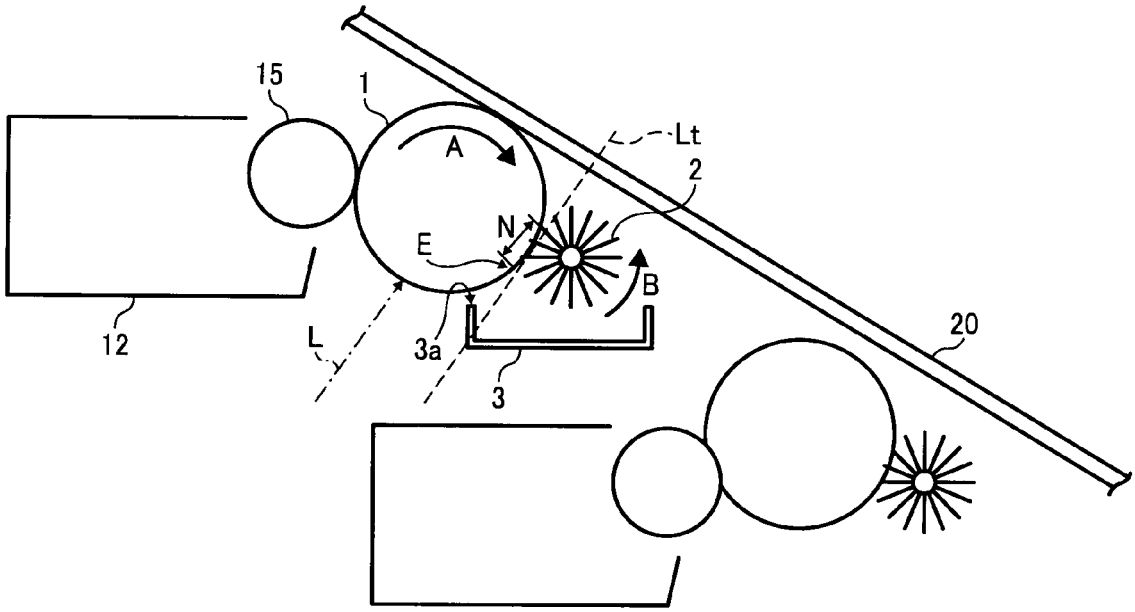
FIG. 7 is a schematic diagram illustrating the rotary brush serving as a charging member when a transfer surface of an intermediate transfer member is disposed facedown in a slanting manner according to an exemplary embodiment of the present invention.

Referring now to FIGS. 6 and 7, there are provided schematic diagrams illustrating the rotary brush 2 serving as the charging member, according to another exemplary embodiment.

In FIG. 6, the transfer surface of the intermediate transfer belt 20 onto which the toner image is transferred from the photoreceptor 1 is in an upright position. In FIG. 7, the transfer surface of the intermediate transfer belt 20 is disposed facedown in a slanting manner. The rotary brush 2 illustrated in FIGS. 6 and 7 is supplied with the charging voltage by a power source, not shown, thereby making it possible to serve as a charging brush.

As illustrated in FIGS. 6 and 7, when the rotary brush 2 serves as the charging mechanism, a separate, dedicated charging member is not needed, thereby reducing the number of parts to be used and providing greater flexibility in the arrangement of parts constituting the image forming unit. Furthermore, the number of parts to which the toner sticks can be reduced.

According to the exemplary embodiment illustrated in FIGS. 6 and 7, the developing area of the photoreceptor 1 where the toner is supplied by the developing roller 15 of the developing unit 12 is substantially above the downstream nip end E. Accordingly, the dispersed toner traveling outside the brush housing 3 can be prevented from reaching the developing area, thereby preventing background contamination due to the toner dispersion from the rotary brush 2.

As illustrated in FIGS. 6 and 7, by providing the developing area substantially above the rotary brush 2, background contamination can be prevented effectively. However, even if the developing area is provided substantially above the rotary brush 2, there is a possibility that the toner traveling from the rotary brush 2 may stick to the intermediate transfer belt 20, and/or may adversely affect the exposure unit 4.

In an attempt to solve such difficulty, the rotary brush 2 and the brush housing 3 are disposed in a manner illustrated in FIGS. 6 and 7 relative to the photoreceptor 1 so as to prevent the toner traveling downstream in the surface movement direction of the photoreceptor 1 from getting dispersed outside the brush housing 3. Accordingly, the toner dispersed from the rotary brush 2 is prevented from sticking to the intermediate transfer belt 20 and/or adversely affecting the exposure unit 4.

According to the exemplary embodiments described above, the rotary brush 2 rotates in the same direction as that of the photoreceptor 1 in the nip N. Alternatively, however, the rotary brush 2 may rotate in the opposite direction relative to the photoreceptor 1 in the nip N. When the rotary brush 2 rotates in the direction opposite to that of the photoreceptor 1 in the nip N, the downstream nip end E of the nip N in the rotation direction of the brush is located at the upstream end of the nip N in the surface movement direction of the photoreceptor 1.

According to the above-described exemplary embodiments, the image forming unit includes the process cartridge 13 integrally including the photoreceptor 1, the rotary brush 2, and the brush housing 3. In the printer 100 serving as an image forming apparatus, as long as the photoreceptor 1, the rotary brush 2, and the brush housing 3 are disposed in the manner illustrated in FIG. 1, 4, 5, 6, or 7, the toner dispersion caused by the rotary brush 2 can be suppressed without integrally including the photoreceptor 1, the rotary brush 2, and the brush housing 3 and forming the process cartridge 13.

According to the exemplary embodiments, the photoreceptor 1 serving as the image bearing member has a drum shape. Alternatively, however, the exemplary position of the rotary brush 2 and the brush housing 3 relative to the photoreceptor 1 can be implemented when using an endless-belt type photoreceptor.

When the endless-belt photoreceptor is used, the rotary brush abuts the belt surface having curvature. The downstream nip end E in the rotation direction of the brush is provided no higher than the center of the curvature of the photoreceptor surface where the rotary brush contacts. The housing end of the housing downstream of the brush is disposed more toward the photoreceptor side further than the tangent to the photoreceptor surface at the downstream nip end in the rotation direction of the brush. Accordingly, the toner dispersion by the rotary brush 2 can be suppressed.

It is to be noted that elements and/or features of different exemplary embodiments may be combined with each other and/or substituted for each other within the scope of this disclosure and appended claims.

Moreover, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A process cartridge, comprising:

a latent image carrier configured to bear an electrostatic latent image on a surface thereof;

a charging unit configured to charge the surface;

a latent image forming unit configured to form the electrostatic latent image on the surface of the latent image carrier charged by the charging unit;

a developing unit configured to supply toner to the electrostatic latent image at a developing area so as to form a toner image;

a transfer unit configured to transfer the toner image onto a transfer medium at a transfer position;

a rotary brush configured to rotate and contact a portion of the latent image carrier surface having curvature so as to form a nip therebetween; and a brush housing configured to cover the rotary brush such that a place where the rotary brush contacts the latent image carrier is opened, the brush housing including a first tip and a second tip, wherein a downstream end of the nip where the rotary brush contacts the latent image carrier in the rotation direction of the rotary brush is configured to be not higher than a center of curvature of the surface of the latent image carrier where the rotary brush contacts, and wherein the first tip of the brush housing is positioned downstream of the rotary brush, at a downstream nip end in the rotation direction of the brush, and toward the latent image carrier further than a tangent to the surface of the latent image carrier at the downstream nip end in the rotation direction of the brush.

2. The process cartridge, according to claim 1, wherein the downstream nip end is configured to be substantially lower than the center of the curvature.

3. The process cartridge according to claim 1, wherein the developing area is configured to be substantially higher than the downstream nip end.

4. The process cartridge according to claim 1, wherein the transfer position is configured to be substantially higher than the downstream nip end.

5. The process cartridge according to claim 1, wherein the rotary brush is a charging brush configured to charge the surface of the latent image carrier.

6. The process cartridge according to claim 1, wherein the rotary brush is a cleaning brush configured to remove toner on the surface of the latent image carrier or disperse toner so as to enable the toner to pass smoothly through the nip.

7. The process cartridge according to claim 6, wherein a charging area, where the charging unit charges the surface of the latent image carrier, is provided downstream of the latent image carrier relative to the downstream nip end in the surface movement direction, which is upstream of the latent image carrier relative to the developing area in the surface movement direction.

8. The process cartridge according to claim 1, wherein the first tip of the brush housing contacts the surface of the latent image carrier.

9. The process cartridge according to claim 1, wherein the first tip of the brush housing is formed of flexible material.

10. An image forming apparatus, comprising:

a latent image carrier configured to bear an electrostatic latent image on a surface thereof;

a charging unit configured to charge the surface of the latent image carrier;

a latent image forming unit configured to form the electrostatic latent image on the surface of the latent image carrier charged by the charging unit;

a developing unit configured to supply toner to the electrostatic latent image at a developing area so as to form a toner image on the latent image carrier;

a transfer unit configured to transfer the toner image onto a transfer medium at a transfer position;

a rotary brush configured to rotate and contact the surface of the latent image carrier forming a nip; and a brush housing configured to cover the rotary brush such that a place where the rotary brush contacts the latent image carrier is opened, the brush housing including a first tip and a second tip, wherein a downstream end of the nip where the rotary brush contacts the latent image carrier in the rotation direction of the rotary brush is configured to be not higher than a center of curvature of the surface of the latent image carrier where the rotary brush contacts, and wherein the first tip of the brush housing is positioned downstream of the rotary brush, at the downstream end of the nip in the rotation direction of the brush, and toward the latent image carrier further than a tangent to the surface of the latent image carrier at the downstream end of the nip in the rotation direction of the brush.

11. The image forming apparatus according to claim 10, wherein the downstream end of the nip is configured to be substantially lower than the center of the curvature.

12. The image forming apparatus according to claim 10, wherein the developing area is configured to be substantially higher than the downstream nip end.

13. The image forming apparatus according to claim 10, wherein the transfer position is configured to be substantially higher than the downstream nip end.

14. The image forming apparatus according to claim 10, wherein the rotary brush is a charging brush configured to charge the surface of the latent image carrier.

15. The image forming apparatus according to claim 10, wherein the rotary brush is a cleaning brush configured to remove toner on the surface of the latent image carrier or cause toner to pass through the nip by dispersing the toner.

16. The image forming apparatus according to claim 15, wherein a charging area, where the charging unit charges the surface of the latent image carrier, is provided downstream of the latent image carrier in the surface movement direction relative to the downstream nip end, which is upstream of the developing area in the surface movement direction of the latent image carrier.

17. The image forming apparatus according to claim 10, wherein the first tip of the brush housing is configured to contact the surface of the latent image carrier.

18. The image forming apparatus according to claim 10, wherein the first tip of the brush housing is formed of flexible material.

19. A method for forming an image, comprising:

bearing an electrostatic latent image on a surface thereof;

charging the surface of the latent image carrier;

forming the electrostatic latent image on the charged surface of the latent image carrier;

supplying toner to the electrostatic latent image at a developing area so as to form a toner image on the latent image carrier;

transferring the toner image onto a transfer medium at a transfer position;

rotating and contacting the surface of the latent image carrier forming a nip; and covering the rotary brush such that a place where the rotary brush contacts the latent image carrier is opened, including a first tip and a second tip, wherein a downstream end of the nip where the rotary brush contacts the latent image carrier in the rotation direction of the rotary brush is configured to be not higher than a center of curvature of the surface of the latent image carrier where the rotary brush contacts, and wherein the first tip of the covered brush is configured to be positioned downstream of the rotary brush, at the downstream end side of the nip in the rotation direction of the brush, and configured to be further toward the latent image carrier than a tangent to the surface of the latent image carrier at the downstream end of the nip in the rotation direction of the brush.

* * * * *